US007401861B2

(12) United States Patent
Purcell et al.

(10) Patent No.: US 7,401,861 B2
(45) Date of Patent: Jul. 22, 2008

(54) APPARATUS FOR REMOVING SURFACE COVERINGS AND METHODS FOR USING SUCH APPARATUS

(75) Inventors: Patrick W. Purcell, 4400 Levis La., Godfrey, IL (US) 62035; Kevin J. Miller, Alton, IL (US)

(73) Assignee: Patrick W. Purcell, Godfrey, IL (US)

( * ) Notice: Subject to any disclaimer, the term of this patent is extended or adjusted under 35 U.S.C. 154(b) by 766 days.

(21) Appl. No.: 10/824,616

(22) Filed: Apr. 15, 2004

(65) Prior Publication Data

US 2004/0244333 A1 Dec. 9, 2004

Related U.S. Application Data

(60) Provisional application No. 60/464,432, filed on Apr. 23, 2003.

(51) Int. Cl.
*E21C 25/00* (2006.01)

(52) U.S. Cl. ..... 299/37.1; 81/45; 15/93.1; 30/169

(58) Field of Classification Search ..... 52/749.1, 52/749.12; 299/37.1, 37.5; 81/45; 15/93.1
See application file for complete search history.

(56) References Cited

U.S. PATENT DOCUMENTS 3,251,629 A * 5/1966 Cawley ..... 299/37.5
4,009,743 A 3/1977 Ackerman
4,086,699 A 5/1978 Olkkola
4,182,390 A 1/1980 Renner
4,221,248 A 9/1980 Rix
4,651,373 A 3/1987 Napolitano
4,663,995 A * 5/1987 Amundson et al. ..... 81/45
4,673,219 A 6/1987 Perciful
4,809,436 A 3/1989 Crookston
4,858,503 A 8/1989 Dike, Jr.
5,001,946 A * 3/1991 Shirlin et al. ..... 81/45
5,010,791 A 4/1991 Williams
5,025,520 A 6/1991 Watkins
5,207,126 A 5/1993 Schaben
5,218,766 A 6/1993 Himebaugh
5,543,003 A 8/1996 Regnier
5,546,671 A 8/1996 Kehoe
D377,140 S 1/1997 Bair
5,813,295 A 9/1998 Jensen, Jr.
5,819,603 A * 10/1998 Murray ..... 81/45
5,829,221 A 11/1998 Archuleta
5,863,100 A * 1/1999 Martin ..... 299/37.1
5,893,304 A 4/1999 Carroll (Continued)

*Primary Examiner*—Richard E. Chilcot
*Assistant Examiner*—Matt J Smith
(74) *Attorney, Agent, or Firm*—Baker Botts, L.L.P.

(57) ABSTRACT

A apparatus for removing surface coverings, includes a shaft having a first end and a second end; a sleeve slidably mounted on the first end of the shaft; a clevis pivotably mounted on a first end of the sleeve; a drive mechanism for shifting a rod between a first rod position and a second rod position relative to the shaft; and a blade mounted on the clevis and extending away from the shaft. The clevis is secured to the rod, such that as the rod moves between the first rod position and the second rod position, the clevis pivots on the sleeve, and the sleeve slides on the shaft to shift a leading edge of the blade between a first edge position and a second edge position.

59 Claims, 5 Drawing Sheets

U.S. PATENT DOCUMENTS

| | | | | | |
|---|---|---|---|---|---|
| 5,906,145 | A | * | 5/1999 | Shepherd | 81/45 |
| D415,174 | S | | 10/1999 | Napolitano | |
| 6,029,545 | A | | 2/2000 | Harpell | |
| 6,047,427 | A | | 4/2000 | Whitlock, Jr. et al. | |
| 6,098,292 | A | | 8/2000 | Harpell | |
| 6,116,117 | A | * | 9/2000 | Nicolosi et al. | 81/45 |
| 6,122,891 | A | | 9/2000 | Carpenter | |
| 6,125,720 | A | | 10/2000 | Gohman | |
| 6,128,979 | A | | 10/2000 | Shepherd | |
| D439,126 | S | | 3/2001 | Gohman | |
| 6,266,834 | B1 | | 7/2001 | Walsh et al. | |
| 6,318,213 | B1 | | 11/2001 | Hendrix et al. | |
| 6,339,975 | B1 | | 1/2002 | Harpell | |
| 6,352,009 | B1 | | 3/2002 | Gaidjiergis | |
| 6,412,382 | B1 | | 7/2002 | Conley | |
| 6,434,909 | B1 | | 8/2002 | Carpenter | |
| 6,453,774 | B1 | | 9/2002 | Khachatoorian | |
| 6,460,210 | B1 | | 10/2002 | Alpert | |
| 6,523,275 | B2 | | 2/2003 | Medford et al. | |

* cited by examiner

APPARATUS FOR REMOVING SURFACE COVERINGS AND METHODS FOR USING SUCH APPARATUS

This application claims the benefit of U.S. Provisional Patent Application No. 60/464,432, filed Apr. 23, 2003, which is incorporated herein by reference.

BACKGROUND OF THE INVENTION

1. Field of the Invention

The invention relates to an apparatus for removing surface coverings and methods for using such apparatus. More particularly, it relates to powered apparatus for removing surface coverings from roofs, including inclined or flat roofs, or from the sides of buildings, or both. Still more particularly, the present invention relates to apparatus having a double-acting cylinder powered by compressed air for removing surface coverings from roofs or from the sides of buildings, or both.

2. Description of Related Art

The exterior surfaces of buildings may be covered with a plurality of overlapping, horizontally aligned rows of shingles. The first row of shingles generally is laid across the lowermost edge of the surface to be covered and fastened, e.g., nailed or stapled, in place at the upper portion of the shingle. Some building surfaces are covered with roll roofing, in which successive sheets of roofing material are overlapped in a similar manner. Roofs for frame houses, particularly roofs which have a wooden roof surface, may be covered with a plurality of layers of roofing materials, such as asphalt shingle or artificial slate. The outer layers are formed by roofing shingles which are somewhat flexible and are formed with projecting, separated flaps, which overlie and are horizontally staggered with respect to a lower course of shingles. Thus, each portion of the roofing surface is covered by a plurality of layers, for example, formed by roofing felt or roofing paper, and then by a first layer of shingles.

Over time, roofing shingles wear out, deteriorate, or suffer damage and lose their effectiveness. Such shingles require periodic removal and replacement. When the shingles wear out or deteriorate, that is, when the surface granulation thereof has worn off, or if the roof becomes damaged due to storms, a second layer of shingles may be laid over the existing shingles. When a shingle roof is replaced, the old shingles may be removed and discarded and replaced by new shingles. Normally, before a new roof is installed on a building, the damaged roofing material is removed. Thus, at some point in the buildings lifetime, it is likely to be necessary to remove a layer or layers of shingles which are already on the roof.

Generally, shingles are fastened, e.g., nailed or stapled, to the roof surface. Roofing nails which have wide flat heads may be used, so that the nails may securely hold the shingle material to the roof surface. The fasteners, e.g., nails, staples, or the like, may not be visible or exposed to weather. As noted above, the fasteners may be placed along the upper edge portion of the shingles of any one course, so that, when the next course of shingles is laid thereover, the fasteners are hidden under the flaps of the succeeding shingles. Because these succeeding shingles are fastened, e.g., nailed or stapled, and held down in the same manner, it may not be possible to merely raise any one flap of a shingle in order to gain access to the fasteners. The flaps frequently hide the fasteners and the succeeding layer of flaps, ascending toward the crown of the roof, tend to hold down the preceding ones. This hold-down effect is a significant reliability feature, maintaining the integrity of the roof under windy or stormy conditions.

To remove the shingles, problems arise in obtaining access to the fasteners. To obtain access to the fasteners and to pry the fasteners up on a fastener-by-fastener, especially, if two layers of shingles are on the roof surface, may be extremely time consuming. During removal the shingles often split or rip, littering the shingled surface with debris which must be removed before a new protective surface may be applied. The roofing fasteners employed to hold down the shingles may tear through the shingles during the lifting process and remain imbedded in the underlying roof surface. After the shingles have been stripped, the remaining fasteners protrude from the roof surface and are either withdrawn from the roof surface or driven down into the roof surface to allow for the application of the new roofing materials. Withdrawing the old roofing fasteners or driving them into the roof surface increases the total required time for removal of the old roofing materials and installation of the new roofing materials, thereby increasing the total cost of the roofing replacement operation.

Proper preparation of an existing roof for replacement shingle installation may be a difficult and time consuming job. Except where only small patches of the roof are to be repaired, a more common practice is to remove very large sections of the old shingles prior to installation of replacements. At present, shingles may be removed manually through a variety of known hand tools. Such tools are often cumbersome to operate, and their use may result in wasted man hours. The steep and often dangerous pitch of known roofs further aggravates the problems encountered in removing shingles with known hand tools.

Pry bars with extending blades exist, which are configured to fit beneath a layer or layers of shingles, or between the roof surface and a layer or layers of shingles, so that a plurality of fasteners may be pried up from the roof surface at one time. Such pry bars, however, tend to deform or break. Moreover, such manual removal processes are tedious, repetitive, laborious, and exhaustive. One or more roofers manually and repeatedly insert the tool beneath a free edge of a shingle layer or layers and pry upwardly to withdraw the fasteners from the roof surface and free the shingles for removal.

In addition, such roofing material removal tools may include a leading flat portion which is intended to be oriented substantially parallel to the surface on which the roofing materials are connected. However, the orientation of the leading edge of the head of the tool may be a function of a number of factors. Such factors include the angular orientation between the handle and the leading edge of the tool, the length of the handle and the height at which the roofer holds the handle in relation to the surface on which the tiles are mounted. The latter factor also tends to be a function of the roofer's height, and whether the roofer holds the handle in a position that is comfortable for the roofer during use, or whether the roofer is compelled to artificially raise or lower the tool, or both, during use.

Back injuries may not result from a single incident or trauma. Repetitive bending or lifting and remaining in awkward postures for prolonged periods, however, may tire back muscles and result in ligament sprains. Sprains occur when back muscles are no longer able to respond to repetitive movements. See Joel Martin, Professional Roofing, www.professionalroofing.net (October 1999). Removing roofing materials by means of such known hand tools may increase significantly the likelihood of back injury.

Various power tools have been developed in an effort to overcome the disadvantages of manual removal processes. While powered, shingle removing tools have been proposed, such tools have suffered from various drawbacks in actual practice. Thus, for example, some such removal tools have not provided appropriate leverage or mechanical advantage at the tip edge of the blade to quickly and conveniently remove shingles.

SUMMARY OF THE INVENTION

A need has arisen for an apparatus for removing surface coverings and methods for using such apparatus, which provide sufficient leverage, such that the apparatus reduces or minimizes fatigue to the user. This advantage is especially desirable as the size of the roof increases, from which a roofer must remove a layer or layers of shingles using the apparatus. It is a further advantage of this apparatus and method that they may be employed with a reduced or minimized amount of expended energy by the user.

A further need has arisen for an apparatus for removing surface coverings, which may efficiently and rapidly remove surface coverings, e.g., a layer or layers of shingles, from building roofs and sides. A still further need has arisen for an apparatus for removing surface coverings, e.g., a layer or layers of shingles, which allows the shingles and securing fasteners to be lifted simultaneously.

Yet a further need has arisen for an apparatus for removing surface coverings, e.g., a layer or layers of shingles, which may be easily manipulated and safely handled by a single roofer even when employed on a pitched roof of a building. The apparatus preferably is sturdy, simple to control and maneuver, and relatively lightweight. Consequently, the apparatus is preferably readily portable and may be powered by convenient sources of energy, such as compressed air, thereby enabling the apparatus to be used in numerous environments.

In an embodiment of the invention, an apparatus for removing surface coverings, comprises a shaft having a first end and a second end; a sleeve slidably mounted on the first end of the shaft; a bracket, e.g., a clevis, pivotably mounted on a first end of the sleeve; a drive mechanism for shifting a rod between a first rod position and a second rod position relative to the shaft; and a blade mounted on the bracket and extending away from the shaft. The bracket is secured to the rod, such that as the rod moves between the first rod position and the second rod position, the bracket pivots on the sleeve, and the sleeve slides on the shaft to shift a leading edge of the blade between a first edge position and a second edge position. The sleeve may extend beyond the first end of the shaft, and the bracket is pivotably mounted on an end of the sleeve extending beyond the first end of the sleeve. Consequently, the leading edge of the blade rises from the first edge position to the second edge position, thereby lifting the surface covering and any attaching fasteners from the building surface. Moreover, the leading edge of the blade may be serrated, e.g., may comprise prongs or teeth or the like to engage the roofing fasteners. In addition, the bracket may comprise means for traversing the building surface with reduced friction or frictionlessly, such as at least one roller or at least one wheel or at least one crawler mechanism, e.g., a track, or at least one skid or the like, and combinations thereof.

The apparatus further may comprise means for limiting the sliding of the sleeve on the shaft. The means for limiting may comprise a flange formed on the shaft, such that when the rod is in the first rod position, a distal end of the sleeve engages the flange. The means for limiting also may comprise a first pin mounted on the shaft, proximate to the first end, and a first oblong hole radially formed through the sleeve distal to the first end of the sleeve, such that the first oblong hole receives the first pin to restrict the sliding of the sleeve on the shaft to a length of the first oblong hole. In addition, the means for limiting may comprise a second pin mounted on the shaft and a second oblong hole radially formed through the sleeve, proximate to the first end of the sleeve, such that the second oblong hole receives the second pin to restrict the sliding of the sleeve on the shaft to a length of the second oblong hole.

The drive mechanism may be mounted on the shaft. If the drive mechanism is adjustably mounted on the shaft, the position of the drive mechanism may be altered to change the angle between the shaft and the building surface when the blade is flush with the building surface. In this manner, a roofer may adjust the angle at which the apparatus engages the roof surface to take into account the pitch of the roof.

In the apparatus, the rod may be retracted into the drive mechanism in the first rod position, and the rod may be extended from the drive mechanism in the second rod position. The drive mechanism may comprise a cylinder and a piston, and the rod may be affixed to the piston. The drive mechanism may be driven hydraulically or by compressed air or the like. Moreover, the drive mechanism, for example, a double-acting cylinder, shifts the rod from the first rod position to the second rod position. A double-acting cylinder may comprise a reciprocating piston within a cylinder with a working chamber at each end of the cylinder. In such a double-acting cylinder, a first working fluid supply line may deliver a first working fluid to a first working chamber of the double-acting cylinder, a second working fluid supply line may deliver a second working fluid to a second working chamber of the double-acting cylinder, and a switch may alternate the delivery of the first working fluid to the first working chamber and the second working fluid to the second working chamber. The first and second working fluids may be the same as or different from each other.

The apparatus further may comprise a switch for activating the drive mechanism to shift the rod between the first rod position and the second rod position. Moreover, the switch may be a two-position switch, such that when the switch is activated, the rod shifts between the first rod position and the second rod position, and when the switch is released, the rod shifts between the second rod position and the first rod position.

The apparatus also may comprise a handle formed on the second end of the shaft. The handle further may comprise a switch for activating the drive mechanism to shift the rod between the first rod position and the second rod position. The handle may be of a design similar to a known shovel handle or may be bent to be substantially perpendicular to the shaft, as depicted in FIG. 9. In addition, the apparatus may comprise an auxiliary handle positioned above the handle to aid in the manipulation and stabilization of the apparatus during use. More specifically, a first arm portion of the auxiliary handle may extend at an acute angle from the shaft toward the handle, a second arm portion may extend from the first arm portion substantially perpendicular to the shaft, and a third arm portion may extend substantially perpendicular to the second arm portion and toward the shaft. In another embodiment, the switch may be located proximate to the drive mechanism and the handle may comprise only an activation mechanism operatively linked by at least one switch activator, e.g., linked by control cables or joined by control linkages, to the switch.

The shaft of the apparatus may be hollow, which may allow the first working fluid supply line and the second working fluid supply line to be disposed within the shaft. An entry opening formed in the shaft may allow the first working fluid supply line and the second working fluid supply line to enter the shaft, and an exit opening formed in the shaft may allow the first working fluid supply line and the second working fluid supply line to exit the shaft. Similarly, if the switch is located proximate to the drive mechanism switch, the activator may be disposed within the shaft, as depicted in FIG. 10.

In still another embodiment, the invention is a method for removing surface coverings using the apparatus disclosed herein. The apparatus for removing surface coverings, comprises a shaft having a first end and a second end; a sleeve slidably mounted on the first end of the shaft; a bracket, e.g., a clevis, pivotably mounted on a first end of the sleeve; a drive mechanism for shifting a rod between a first rod position and a second rod position relative to the shaft; and a blade mounted on the bracket and extending away from the shaft. The bracket is secured to the rod, such that as the rod moves between the first rod position and the second rod position, the bracket pivots on the sleeve, and the sleeve slides on the shaft to shift a leading edge of the blade between a first edge position and a second edge position. The apparatus further comprises a handle formed on the second end of the shaft. The handle further may comprise a two-position switch or activation mechanism for activating the drive mechanism, such that when the switch is depressed, the rod shifts between the first rod position and the second rod position, and when the switch is released, the rod shifts between the second rod position and the first rod position. The method comprises the steps of sliding the blade of the apparatus along a building surface and forcing the blade underneath the surface covering; triggering the switch or activation mechanism for activating the drive mechanism to shift the rod between the first rod position and the second rod position; maintaining the apparatus against the building surface; and releasing the switch or activation mechanism, so that the drive mechanism shifts the rod between the second rod position and the first rod position. The method may further comprise the step of adjusting an operating angle between the building surface and the shaft.

In yet another embodiment of the invention, an apparatus for removing surface coverings, comprises a shaft having a first end and a second end and having a first pin mounted on the shaft proximate to the first end; a sleeve, having an first oblong hole radially formed therethrough, extending beyond and slidably mounted on the first end of the shaft, such that the first oblong hole receives the first pin to restrict the sliding of the sleeve on the shaft to a length of the first oblong hole; a bracket, e.g., a clevis, pivotably mounted on an end of the sleeve extending beyond the first end of the shaft; a drive mechanism mounted on the shaft for shifting a rod between a retracted rod position and an extended rod position; and a blade mounted on the bracket and extending away from the shaft. The bracket is secured to the rod, such that as the rod moves between the retracted rod position and the extended rod position, the bracket pivots on the sleeve, and the sleeve slides on the shaft to shift a leading edge of the blade from a lowered edge position and a raised edge position. In addition, as noted above, the bracket may comprise means for traversing the building surface with reduced friction or frictionlessly.

Other objects, features, and advantages will be apparent to those of ordinary skill in the relevant art in view of the following detailed description of preferred embodiments and the accompanying drawings.

BRIEF DESCRIPTION OF THE DRAWINGS

Embodiments of the invention now are described with reference to the accompanying figures, which are given by way of example only, and are not intended to limit the scope of the present invention.

FIGS. 4A-C are front, top, and side views, respectively, of a cylinder mounting clevis 40 of FIG. 1.

DETAILED DESCRIPTION OF PREFERRED EMBODIMENTS

FIGS. 1-10 depict embodiments of the invention. Like numerals are used to identify the same or similar elements in each embodiment.

Figures 1, 2, 3:
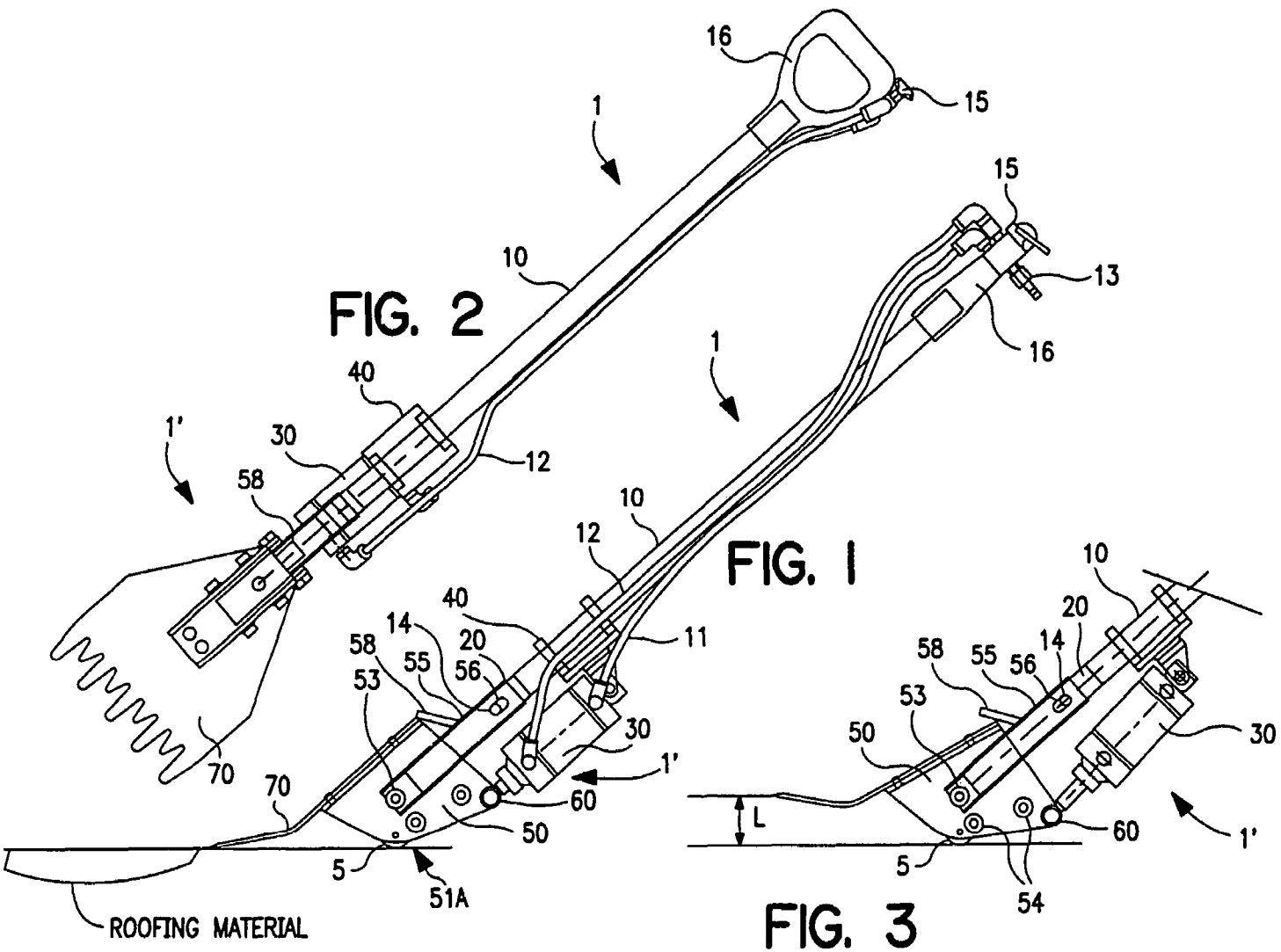
FIG. 1 is a side view of an apparatus for removing surface coverings, according to an embodiment of the present invention.
FIG. 2 is a plan view of the apparatus for removing surface coverings of FIG. 1.
FIG. 3 is an enlarged, side view of the apparatus for removing surface coverings of FIG. 1.
Figure 9:
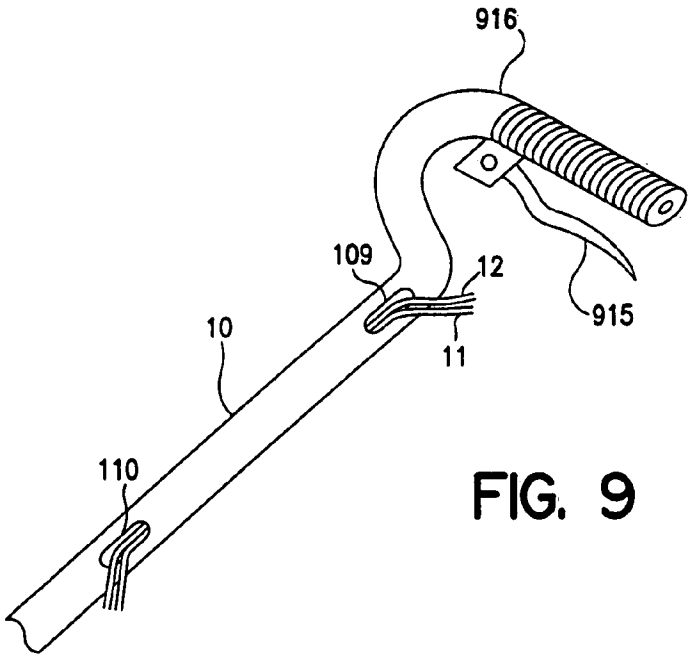
FIG. 9 is a perspective view of a handle for an apparatus for removing surface coverings, according to still another embodiment of the present invention.

FIG. 1 is a side view of an apparatus 1 for removing surface coverings, according to an embodiment of the present invention. This figure depicts a view of apparatus 1 as a roofer would position it to remove roofing materials, comprising a blade 70, which pivots on a fulcrum 51A, at which a blade clevis 50 contacts the building surface. In addition, clevis 50 may comprise means for traversing the building surface with reduced friction or frictionlessly, such as a roller 5, disposed at or proximate to fulcrum 51A. A switch 15, such as a finger operated, directional control valve, is mounted to a handle 16 and connected to a second end of shaft 10 and via shaft 10 to a working head 1' of apparatus 1. In FIG. 9, another embodiment of a handle 916 and a lever switch 915, such as a dead man's switch, is depicted.

Figure 5C:
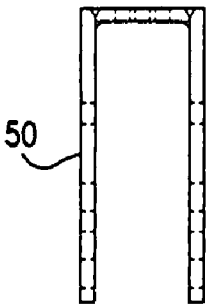
FIGS. 5A-C are side, top, and front views, respectively, of a blade clevis 50 of FIG. 1.
Figure 5B:
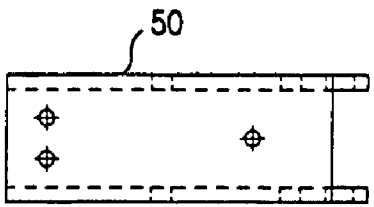
Figure 5A:
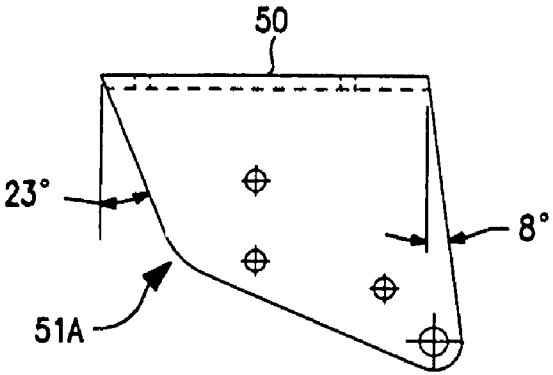
Figure 6B:
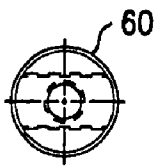
FIGS. 6A-B are top and side views, respectively, of a pivot 60 pivotally connecting blade clevis 50 to a double-acting cylinder 30 of FIG. 1.
Figure 6A:
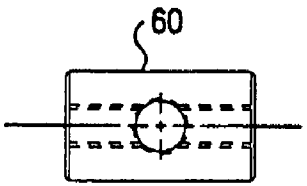

Referring to FIG. 3, working head 1' comprises blade 70, blade clevis 50, a double-acting air cylinder 30 and a cylinder mounting bracket 40, and a sleeve 55 slidably mounted on a first end of shaft 10. FIGS. 5A-C are side, top, and front views, respectively, of blade clevis 50 of FIG. 1. Blade clevis 50 is configured to allow the attachment of blade 70, such that blade 50 extends away from blade clevis 50. As depicted in FIG. 5A, blade clevis 50 may have offsets of about 23° and about 8° on the sides adjacent and opposite to fulcrum 51A. FIGS. 6A-B are top and side views, respectively, of a pivot 60 pivotally connecting blade clevis 50 to a double-acting cylinder 30 of FIG. 1. Pivot 60 is mounted in blade clevis 50 to allow attachment at a rod end of double-acting air cylinder 30 to the blade clevis 50. A first bolt 53, such as an about 9.525 mm (⅜ inch) diameter, hardened bolt, is inserted through both blade clevis 50 and sleeve 55. Bolt 53 acts as an additional pivot point between working head 1' and shaft 10. Two additional bolts 54, such as two, about 9.525 mm (⅜ inch) diameter bolts, act as stiffeners to provide additional rigidity to the mounting of blade clevis 50. Sleeve 55 further may comprise a gap shield 58 which extends toward a trailing edge of blade 70.

FIG. 2 is a plan view of the apparatus for removing surface coverings of FIG. 1. This figure depicts a view of apparatus 1 and, in particular, the configuration of blade 70 and other elements of working head 1'. As depicted in FIG. 2, the leading or working edge of blade 70 may be serrated, e.g., formed with teeth or prongs or similar protrusions to engage fasteners, e.g., nails, stables, or the like, which are used to secure the surface coverings, e.g., a layer or layers of roofing shingles, to a building surface. Blade 70 may be attached to blade clevis 50 by a plurality of bolts. Blade 70 is formed to provide an obtuse angle between the surface coverings to be removed and shaft 10. Referring again to FIG. 2, blade 70 has three holes formed therethrough for mounting to blade 70 to blade clevis 50 utilizing carriage bolts or the like.

As noted above, the drive mechanism may comprise a cylinder and a piston (not shown), and the rod may be affixed to the piston. Preferably, the drive mechanism is double-acting air cylinder 30, which shifts the rod from a retracted rod position to an extended rod position. In such a double-acting cylinder, a first working fluid supply line 11 may deliver a first working fluid to a first working chamber (not shown) of the double-acting cylinder, a second working fluid supply line 12 may deliver a second working fluid to a second working chamber (not shown) of the double-acting cylinder, and switch 15 may alternate the delivery of the first working fluid to the first working chamber and the second working fluid to the second working chamber. The first and second working fluids may be the same as or different from each other. With respect to double action air cylinder 30, compressed air is supplied to apparatus 1 by means of an inlet 13, as depicted in FIG. 1. By activating switch 15, e.g., the fingered operated, directional control valve, compressed air may be supplied alternatively to each working chamber of double-acting air cylinder 30 via first and second working fluid supply lines 11 and 12, respectively, e.g., a pair of about 9.525 mm (⅜ inch) diameter, compressed air supply lines. Cylinder activation forces the piston of double-acting air cylinder 30 of apparatus 1 to move forward by about 25.4 mm (one (1) inch) by means of first end 20 of shaft 10 that slides within sleeve 55. After working head 1' moves forward, working head 1' then pivots on fulcrum 51A, lifting blade 70 by a distance L, e.g., about 50.8 mm (2 inches), as depicted in FIG. 3, away from and above the building surface. Consequently, raised blade 70 removes the old, worn, deteriorated, or damaged surface covering, including fasteners, such as nails, staples, or the like, from the building surface.

Referring to FIG. 1, sleeve 55 further may comprise gap shield 58 which extends toward a trailing edge of blade 70. When working head 1' is moved forward and blade 70 lifted by the operation of double-acting air cylinder 30, the trailing edge of blade 70 passes along gap shield 58 toward sleeve 55, as depicted in FIG. 3. Thus, gap shield 58 prevents objects, such as old, worn, deteriorated, or damaged surface covering, including fasteners, such as nails, staples, or the like, from the building surface, from entering the gap between or becoming wedged between blade 70 and shaft 10 or sleeve 55 and, thereby, interfering with the operation of apparatus 1.

Referring again to FIG. 9, shaft 10 of apparatus 1 may be hollow, which may allow first working fluid supply line 11 and second working fluid supply line 12 to be disposed within shaft 10. An entry opening 109 formed in the shaft may allow first working fluid supply line 11 and second working fluid supply line 12 to enter shaft 10, and an exit opening 110 formed in shaft 10 may allow first working fluid supply line 11 and second working fluid supply line 12 to exit shaft 10. By running first working fluid supply line 11 and second working fluid supply line 12 through hollow shaft 10, supply lines 11 and 12 may be protected from wear, puncture, and other damage caused by contact with the removed surface coverings or with the fasteners used to secure the surface coverings. Further, by running supply lines 11 and 12 within shaft 10, the likelihood that the operator or materials at the removal site may become entangled in lines 11 and 12 is reduced or eliminated.

Figure 10:
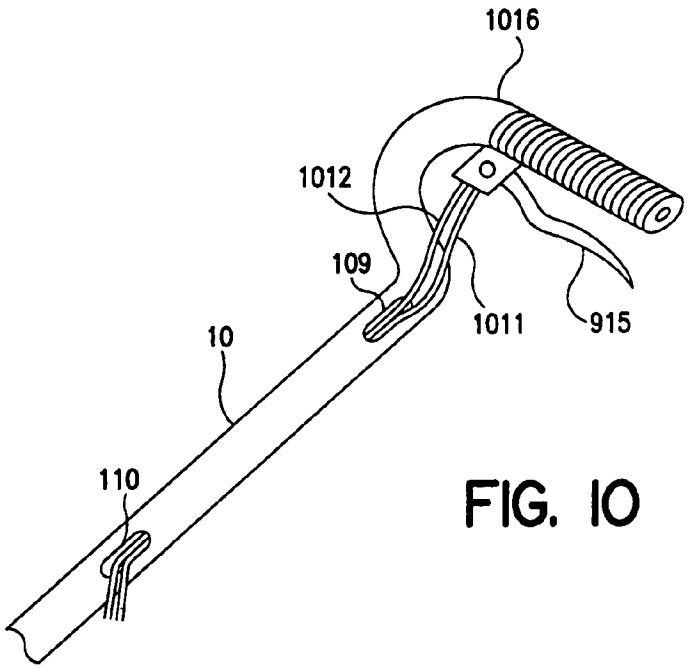
FIG. 10 is a perspective view of a handle for an apparatus for removing surface coverings, according to yet another embodiment of the present invention.

Similarly, in FIG. 10, shaft 10 of apparatus 1 may be hollow, which may allow a first control cable 1011 and a second control cable 1012 to be disposed within shaft 10. An entry opening 109 formed in the shaft may allow first control cable 1011 and a second control cable 1012 to enter shaft 10, and an exit opening 110 formed in shaft 10 may allow first control cable 1011 and a second control cable 1012 to exit shaft 10. By running first working fluid supply line 11 and second working fluid supply line 12 through hollow shaft 10, control cables 1011 and 1012 may be protected from wear, severance, and other damage caused by contact with the removed surface coverings or with the fasteners used to secure the surface coverings. Further, by running control cables 1011 and 1012 within shaft 10, the likelihood that the operator or materials at the removal site may become entangled in control cables 1011 and 1012 is reduced or eliminated. Control cables 1011 and 1012 may be operatively attached to handle 1016 and a lever 1015. The elements depicted in FIGS. 9 and 10 further may be combined, such that first working fluid supply line 11 and second working fluid supply line 12, as well as first control cable 1011 and a second control cable 1012, may be disposed within shaft 10.

Figure 4C:
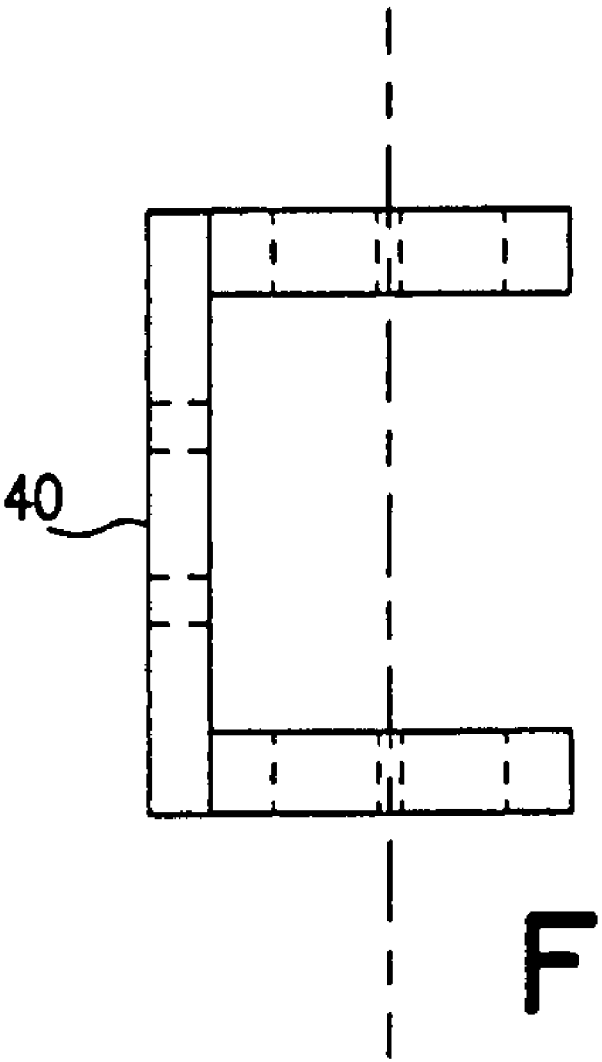

The force generated by double-acting air cylinder 30 applied between blade clevis 50 and the cylinder mount 40 accomplishes the pivoting action. Double-acting air cylinder 30 is attached shaft 10 via cylinder mounting bracket 40 utilizing a plurality of bolts, e.g., four, hex head bolts. FIGS. 4A-C are front, top, and side views, respectively, of cylinder mounting bracket 40 of FIG. 1. Cylinder mounting bracket 40 may be clamped to shaft 10 utilizing two clamps on collars of cylinder mounting bracket 40. Again, as noted above, double-acting air cylinder 30 may be adjustably mounted on shaft 10, and the position of double-acting air cylinder 30 may be altered along shaft 10 to change the angle between shaft 10 and the building surface when blade 70 is flush with the building surface. In this manner, a roofer may adjust the angle at which apparatus 1 engages the roof surface to take into account the pitch of the roof.

Similarly, in FIG. 10, shaft 10 of apparatus 1 may be hollow, which may allow a first control cable 1011 and a second control cable 1012 to be disposed within shaft 10. An entry opening 109 formed in the shaft may allow first control cable 1011 and a second control cable 1012 to enter shaft 10, and an exit opening 110 formed in shaft 10 may allow first control cable 1011 and a second control cable 1012 to exit shaft 10. By running first working fluid supply line 11 and second working fluid supply line 12 through hollow shaft 10, control cables 1011 and 1012 may be protected from wear, severance, and other damage caused by contact with the removed surface coverings or with the fasteners used to secure the surface coverings. Further, by running control cables 1011 and 1012 within shaft 10, the likelihood that the operator or materials at the removal site may become entangled in control cables 1011 and 1012 is reduced or eliminated. Control cables 1011 and 1012 may be operatively attached to handle 1016 and a lever 915. The elements depicted in FIGS. 9 and 10 further may be combined, such that first working fluid supply line 11 and second working fluid supply line 12, as well as first control cable 1011 and a second control cable 1012, may be disposed within shaft 10.

In another embodiment, the invention is a method for removing surface coverings from a building using the apparatus disclosed above. For example, a roofer may slides apparatus 1 along the roof surface forcing apparatus 1 underneath the roofing material to be removed. The roofer my activate switch 15, e.g., a finger operated, directional control valve, is activated causing working head 1' to advance forward about 25.4 mm (one (1) inch) before lifting blade 70 off the roof surface, the combined forward and lifting motion of apparatus 1 removes the old, worn, deteriorated, or damaged roofing material from the roof surface. By maintaining the position of apparatus 1 with fulcrum 51A against the roof surface as shown in FIG. 1, the roofer is relieved of the forces required to remove the old roofing material and fasteners. After the old material is removed the roofer releases switch 15. Compressed air then is supplied via second working fluid supply line 12 to a second working chamber of double-acting air cylinder 30. With the rod of double-acting air cylinder 30 in a retracted position, apparatus 1 is advanced forward and under the next section of roofing material to be removed. The angle of blade 70 allows the old roofing material to be forced forward and raised in advance of the roofer as apparatus 1 is continuously advanced. Moreover, the operating angle between the roof surface and shaft 10 may be adjusted. By loosening the clamps on the collars of cylinder mounting bracket 40, the roofer may slide double-acting air cylinder 30 along shaft 10. By changing the location of double-acting air cylinder 30, the roofer may change operating angle between the roof surface and shaft 10.

Figures 7, 8:
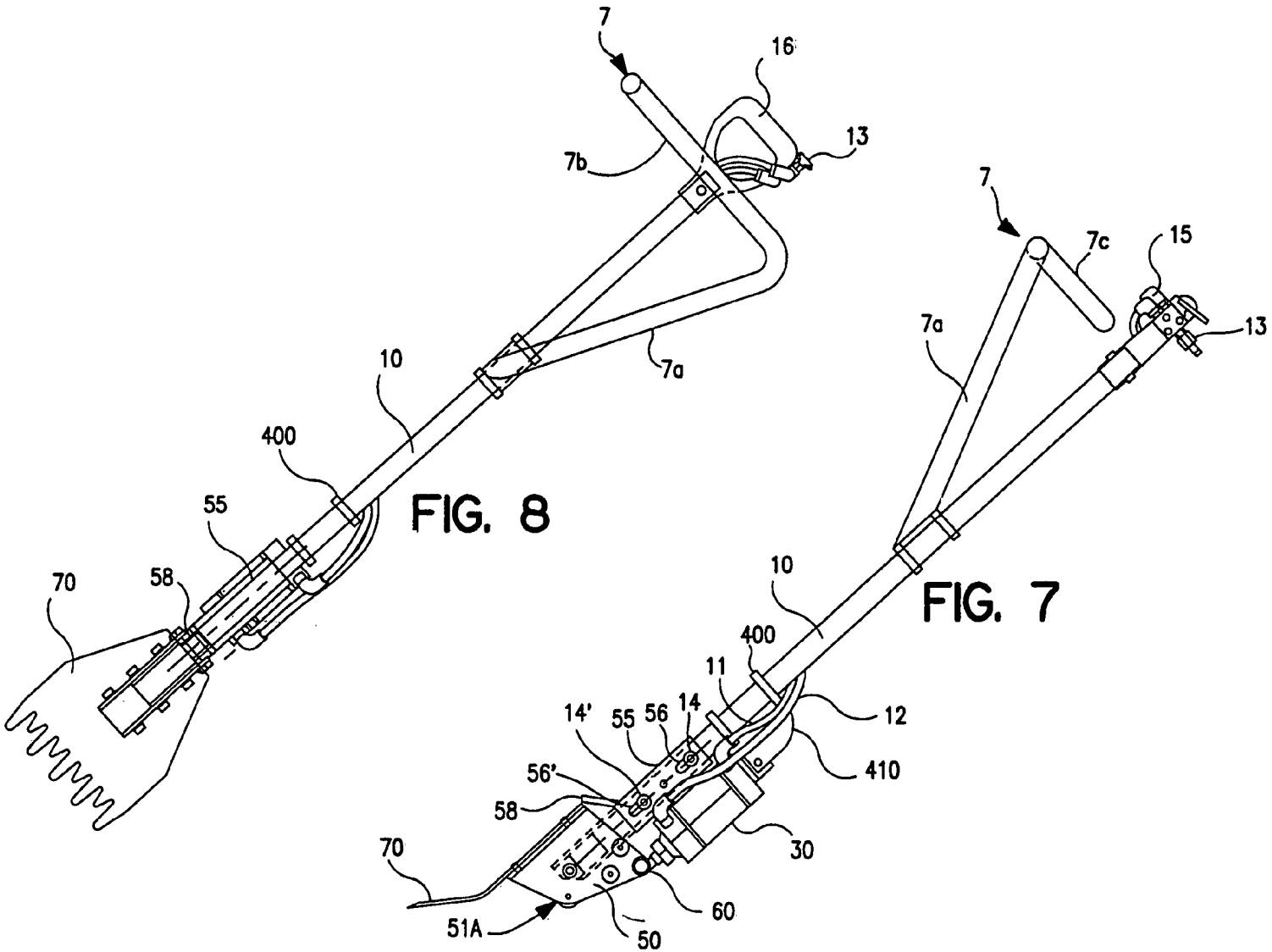
FIG. 7 is a side view of an apparatus for removing surface coverings having a stabilizing handle, according to another embodiment of the present invention.
FIG. 8 is a plan view of the apparatus for removing surface coverings of FIG. 7.

FIG. 7 is a side view of an apparatus for removing surface coverings having a stabilizing handle, according to another embodiment of the present invention; and FIG. 8 is a plan view of the apparatus for removing surface coverings of FIG. 7. Referring to FIGS. 7 and 8, apparatus 1 may comprise an auxiliary handle 7 positioned above handle 16 to aid in the manipulation and stabilization of apparatus 1 during use. More specifically, a first arm portion 7*a* of auxiliary handle 7 may extend at an acute angle from shaft 10 toward handle 16, a second arm portion 7*b* may extend from first arm portion 7*a* substantially perpendicular to shaft 10, and a third arm portion 7*c* may extend substantially perpendicular to second arm portion 7*b* and toward shaft 10. In addition, shaft 10 of apparatus 1 may comprise first pin 14 formed or mounted on shaft 10 proximate to first end 20 and a second pin 14' formed or mounted on shaft 10 proximate to the end of sleeve 55. Further, sleeve 55 may comprise first oblong hole 56 and a second oblong hole 56' radially formed therethrough, such that when sleeve 55 is slidably mounted on shaft 10, first oblong hole 56 receives first pin 14 and second oblong hole 56' receives second pin 14' to restrict the sliding of sleeve 55 on shaft 10 to a length of oblong holes 56 and 56', e.g., about 12.7 mm (½ inch).

Referring to FIG. 7, sleeve 55 further may comprise gap shield 58 which extends toward a trailing edge of blade 70. When working head 1' is moved forward and blade 70 lifted by the operation of double-acting air cylinder 30, the trailing edge of blade 70 passes along gap shield 58 toward sleeve 55. Thus, as with the embodiment depicted in FIGS. 1 and 3, gap shield 58 prevents objects, such as old, worn, deteriorated, or damaged surface covering, including fasteners, such as nails, staples, or the like, from the building surface, from entering the gap between or becoming wedged between blade 70 and shaft 10 or sleeve 55 and, thereby, interfering with the operation of apparatus 1.

As with the embodiment depicted in FIGS. 1-3, with respect to FIGS. 7 and 8, the force generated by double-acting air cylinder 30 applied between blade clevis 50 and a cylinder mount 400 accomplishes the pivoting action. Double-acting air cylinder 30 is attached shaft 10 via a cylinder support arm 410 and cylinder mounting bracket 400 utilizing a plurality of bolts. Cylinder mounting bracket 400 may be clamped to shaft 10 utilizing two clamps on collars of cylinder mounting bracket 400. Again, as noted above, double-acting air cylinder 30 may be adjustably mounted on shaft 10, and the position of double-acting air cylinder 30 may be altered along shaft 10 to change the angle between shaft 10 and the building surface when blade 70 is flush with the building surface.

Although preferred embodiments of the present invention have been described in detail herein, the scope of the invention is not limited thereto. It will be appreciated by those of ordinary skill in the relevant art that various modifications may be made without departing from the scope of the invention. Accordingly, the embodiments disclosed herein are only exemplary. It is to be understood that the scope of the invention is not to be limited thereby, but is to be determined by the claims which follow.

What is claimed is:

1. An apparatus for removing surface coverings, comprising a shaft having a first end and a second end;

a sleeve slidably mounted on said first end of said shaft;

a bracket pivotably mounted on a first end of said sleeve;

a drive mechanism for shifting a rod between a first rod position and a second rod position relative to said shaft; and a blade mounted on said bracket and extending away from said shaft;

wherein said bracket is secured to said rod, such that as said rod moves between said first rod position and said second rod position, said bracket pivots on said sleeve and said sleeve slides on said shaft to shift a leading edge of said blade between a first edge position and a second edge position.

2. The apparatus of claim 1, further comprising means for limiting the sliding of said sleeve on said shaft.

3. The apparatus of claim 2, wherein said means for limiting comprises a flange formed on said shaft, such that when said rod is in said first rod position, a distal end of said sleeve engages said flange.

4. The apparatus of claim 2, wherein said means for limiting comprises a first pin mounted on said shaft proximate to said first end and a first oblong hole radially formed through said sleeve distal to said first end of said sleeve, such that said first oblong hole receives said first pin to restrict the sliding of said sleeve on said shaft to a length of said first oblong hole.

5. The apparatus of claim 4, wherein said means for limiting further comprises a second pin mounted on said shaft and a second oblong hole radially formed through said sleeve proximate to said first end of said sleeve, such that said second oblong hole receives said second pin to restrict the sliding of said sleeve on said shaft to a length of said second oblong hole.

6. The apparatus of claim 1, wherein said sleeve extends beyond said first end of said shaft and said bracket is pivotably mounted on an end of said sleeve extending beyond said first end of said sleeve.

7. The apparatus of claim 1, wherein said drive mechanism is mounted on said shaft.

8. The apparatus of claim 1, wherein said rod is retracted into said drive mechanism in said first rod position and said rod is extended from said drive mechanism in said second rod position.

9. The apparatus of claim 1, wherein said drive mechanism is a double-acting cylinder.

10. The apparatus of claim 9, further comprising a first working fluid supply line for delivering a first working fluid to a first working chamber of said double-acting cylinder, a second working fluid supply line for delivering a second working fluid to a second working chamber of said double-acting cylinder, and a switch for alternating the delivery of said first working fluid to said first working chamber and said second working fluid to said second working chamber.

11. The apparatus of claim 10, wherein said shaft is hollow and wherein said first working fluid supply line and said second working fluid supply line are disposed within said shaft.

12. The apparatus of claim 11, further comprising an entry opening formed in said shaft allowing said first working fluid supply line and said second working fluid supply line to enter said shaft and an exit opening formed in said shaft allowing said first working fluid supply line and said second working fluid supply line to exit said shaft.

13. The apparatus of claim 10, wherein said first working fluid is compressed air.

14. The apparatus of claim 10, wherein said second working fluid is compressed air.

15. The apparatus of claim 10, wherein said first working fluid is the same as said second working fluid.

16. The apparatus of claim 1, wherein said drive mechanism shifts said rod from said first rod position to said second rod position.

17. The apparatus of claim 1, wherein said drive mechanism comprises a cylinder and a piston and wherein said rod is affixed to said piston.

18. The apparatus of claim 17, wherein said drive mechanism is driven by compressed air.

19. The apparatus of claim 17, wherein said drive mechanism is hydraulically driven.

20. The apparatus of claim 1, wherein said leading edge of said blade is raised from said first edge position to said second edge position.

21. The apparatus of claim 1, further comprising a switch for activating said drive mechanism to shift said rod between said first rod position and said second rod position.

22. The apparatus of claim 21, wherein said switch is a two-position switch, such that when said switch is depressed, said rod shifts between said first rod position and said second rod position, and when said switch is released, said rod shifts between said second rod position and said first rod position.

23. The apparatus of claim 21, wherein said switch is located proximate to said drive mechanism and wherein said shaft is hollow and at least one switch activator is disposed within said shaft to activate and deactivate said switch.

24. The apparatus of claim 23, further comprising an entry opening formed in said shaft allowing said at least one switch activator comprising a first control cable and a second control cable to enter said shaft and an exit opening formed in said shaft allowing said first control cable and said second control cable to exit said shaft.

25. The apparatus of claim 1, wherein said edge of said blade is serrated.

26. The apparatus of claim 25, wherein said handle further comprises a switch for activating said drive mechanism to shift said rod between said first rod position and said second rod position.

27. The apparatus of claim 25, wherein said handle is substantially perpendicular to said shaft.

28. The apparatus of claim 25, further comprising an auxiliary handle positioned above said handle.

29. The apparatus of claim 28, wherein a first arm portion of said auxiliary handle extends at an acute angle from said shaft toward said handle, a second arm portion extends from said first arm portion substantially perpendicular to said shaft, and a third arm portion extends substantially perpendicular to said second arm portion and toward said shaft.

30. The apparatus of claim 1, further comprising a handle formed on said second end of said shaft.

31. The apparatus of claim 30, wherein said switch is a two-position switch, such that when said switch is depressed, said rod shifts between said first rod position and said second rod position, and when said switch is released, said rod shifts between said second rod position and said first rod position.

32. The apparatus of claim 1, further comprising a shield extending from said sleeve toward a trailing edge of said blade.

33. The apparatus of claim 1, wherein said bracket further comprises means for traversing the building surface.

34. The apparatus of claim 33, wherein said means for traversing is a roller mounted substantially perpendicular to said shaft.

35. An apparatus for removing surface coverings, comprising a shaft having a first end and a second end and having a pin mounted on said shaft proximate to said first end;

a sleeve, having an oblong hole radially formed therethrough, extending beyond and slidably mounted on said first end of said shaft, such that said oblong hole receives said pin to restrict the sliding of said sleeve on said shaft to a length of said oblong hole;

a bracket pivotably mounted on an end of said sleeve extending beyond said first end of said shaft;

a drive mechanism mounted on said shaft for shifting a rod between a retracted rod position and an extended rod position; and a blade mounted on said bracket and extending away from said shaft;

wherein said bracket is secured to said rod, such that as said rod moves between said retracted rod position and said extended rod position, said bracket pivots on said sleeve and said sleeve slides on said shaft to shift a leading edge of said blade from a lowered edge position and a raised edge position.

36. The apparatus of claim 35, wherein said drive mechanism is a double-acting cylinder.

37. The apparatus of claim 36, further comprising a first working fluid supply line for delivering a first working fluid to a first working chamber of said double-acting cylinder, a second working fluid supply line for delivering a second working fluid to a second working chamber of said double-acting cylinder, and a switch for alternating the delivery of said first working fluid to said first working chamber and said second working fluid to said second working chamber.

38. The apparatus of claim 37, wherein said shaft is hollow and said first working fluid supply line and said second working fluid supply line are disposed within said shaft.

39. The apparatus of claim 38, further comprising an entry opening formed in said shaft allowing said first working fluid supply line and said second working fluid supply line to enter said shaft and an exit opening formed in said shaft allowing said first working fluid supply line and said second working fluid supply line to exit said shaft.

40. The apparatus of claim 37, wherein said first working fluid is compressed air.

41. The apparatus of claim 37, wherein said second working fluid is compressed air.

42. The apparatus of claim 37, wherein said first working fluid is the same as said second working fluid.

43. The apparatus of claim 35, wherein said drive mechanism shifts said rod from said retracted rod position to said extended rod position.

44. The apparatus of claim 35, wherein said drive mechanism comprises a cylinder and a piston and wherein said rod is affixed to said piston.

45. The apparatus of claim 44, wherein said drive mechanism is driven by compressed air.

46. The apparatus of claim 45, wherein said switch is located proximate to said drive mechanism and wherein said shaft is hollow and at least one switch activator is disposed within said shaft to activate and deactivate said switch.

47. The apparatus of claim 46, further comprising an entry opening formed in said shaft allowing said at least one switch activator comprising a first control cable and a second control cable to enter said shaft and an exit opening formed in said shaft allowing said first control cable and said second control cable to exit said shaft.

48. The apparatus of claim 44, wherein said drive mechanism is hydraulically driven.

49. The apparatus of claim 35, further comprising a switch for activating said drive mechanism to shift said rod between said retracted rod position and said extended rod position.

50. The apparatus of claim 49, wherein said switch is a two-position switch, such that when said switch is depressed, said rod shifts between said retracted rod position and said extended rod position, and when said switch is released, said rod shifts between said extended rod position and said retracted rod position.

51. The apparatus of claim 35, wherein said edge of said blade is serrated.

52. The apparatus of claim 35, further comprising a handle formed on said second end of said shaft.

53. The apparatus of claim 52, wherein said handle further comprises a switch for activating said drive mechanism to shift said rod between said first rod position and said second rod position.

54. The apparatus of claim 52, wherein said handle is substantially perpendicular to said shaft.

55. The apparatus of claim 52, further comprising an auxiliary handle positioned above said handle.

56. The apparatus of claim 55, wherein a first arm portion of said auxiliary handle extends at an acute angle from said shaft toward said handle, a second arm portion extends from said first arm portion substantially perpendicular to said shaft, and a third arm portion extends substantially perpendicular to said second arm portion and toward said shaft.

57. The apparatus of claim 35, further comprising a shield extending from said sleeve toward a trailing edge of said blade.

58. A method for removing surface coverings from a building using said apparatus of claim 31, comprising the steps of:

sliding said blade of said apparatus along a building surface and forcing said blade underneath said surface covering;

triggering said switch for activating said drive mechanism to shift said rod between said first rod position and said second rod position;

maintaining said apparatus against said building surface; and releasing said switch, so that said drive mechanism shifts said rod between said second rod position and said first rod position.

59. The method of claim 58, further comprising the step of adjusting an operating angle between said building surface and said shaft.

* * * * *